United States Patent [19]

Sung et al.

[11] 4,391,610

[45] Jul. 5, 1983

[54] LIQUID HYDROCARBON FUEL CONTAINING A CORROSION INHIBITOR, DIALKOXYLATED ALKYL POLYOXYALKYL PRIMARY AMINE

[75] Inventors: Rodney L. Sung, Fishkill; William M. Sweeney, Wappingers Falls, both of N.Y.; Wheeler C. Crawford, Houston, Tex.

[73] Assignee: Texaco Inc., White Plains, N.Y.

[21] Appl. No.: 338,196

[22] Filed: Jan. 8, 1982

[51] Int. Cl.[3] ..... C10L 1/22

[52] U.S. Cl. ..... 44/56; 44/72; 252/392

[58] Field of Search ..... 44/56, 72; 252/392

[56] References Cited

U.S. PATENT DOCUMENTS

| | | | |
|---|---|---|---|
| 1,989,528 | 1/1935 | Rather et al. | 44/72 |
| 2,902,354 | 9/1959 | Giammaria | 44/72 |
| 2,974,023 | 3/1961 | Cyba et al. | 252/392 |
| 3,203,904 | 8/1965 | Brown | 252/392 |
| 3,637,358 | 1/1972 | Cyba | 44/72 |

*Primary Examiner*—Charles F. Warren
*Assistant Examiner*—Y. Harris-Smith
*Attorney, Agent, or Firm*—Carl G. Ries; Robert A. Kulason; Carl G. Seutter

[57] ABSTRACT

A novel fuel composition containing a hydrocarbon boiling in the gasoline boiling range plus optionally ethanol or methanol plus, as a corrosion inhibitor, a dialkoxylated alkyl polyoxyalkyl primary amine

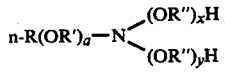

typified by

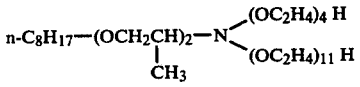

20 Claims, No Drawings

LIQUID HYDROCARBON FUEL CONTAINING A CORROSION INHIBITOR, DIALKOXYLATED ALKYL POLYOXYALKYL PRIMARY AMINE

FIELD OF THE INVENTION

This invention relates to a fuel composition for internal combustion engines particularly characterized by corrosion inhibition.

BACKGROUND OF THE INVENTION

As is well known to those skilled in the art, fuel compositions typified by gasohol and alcohols which are to be considered for commercial use must possess low corrosion activity; and this may be effected by addition thereto of various corrosion inhibition systems. It is an object of this invention to provide a fuel composition for internal combustion engines particularly characterized by corrosion inhibition. Other objects will be apparent to those skilled in the art.

STATEMENT OF THE INVENTION

In accordance with certain of its aspects, the fuel composition of this invention may comprise (a) a major portion of a fuel containing a hydrocarbon boiling in the gasoline boiling range plus optionally at least one alcohol selected from the group consisting of ethanol and methanol; and (h) a minor corrosion inhibiting amount of, as a corrosion inhibiting agent, a dialkoxylated alkyl polyoxyalkyl primary amine

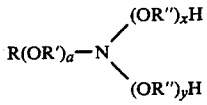

wherein R is an alkyl group, R′ and R″ are divalent alkylene groups, x+y is 2–20 and a is 1–20.

DESCRIPTION OF THE INVENTION

The base fuel which is useful for employing the additive of the invention may be a motor fuel composition comprising a mixture of hydrocarbons boiling in the gasoline boiling range. This base fuel may contain straight chain or branch chain paraffins, cycloparaffins, olefins, and aromatic hydrocarbons and any mixture of these. The base fuel may be derived from straight-chain naphtha, polymer gasoline, natural gasoline, catalytically cracked or thermally cracked hydrocarbons, catalytically reformed stocks etc. It may typically boil in the range from about 80° to 450° F. Any conventional motor fuel base may be employed in the practice of this invention.

Gasohols may be employed typically containing 90–95 volume % of gasoline and 5–10 volume % methanol or ethanol. A typical gasohol contains 90 v % gasoline and 10 v % ethanol.

The fuel composition of the invention may contain any of the additives normally employed in a motor fuel. For example, the base fuel may be blended with antiknock compounds, such as tetraalkyl lead compounds, including tetraethyl lead, tetramethyl lead, tetrabutyl lead, etc. or cyclopentadienyl manganese tricarbonyl generally in a concentration from about 0.05 to 4.0 cc. per gallon of gasoline. The tetraethyl lead mixture commercially available for automotive use contains an ethylene chloride-ethylene bromide mixture as a scavenger for removing lead from the combustion chamber in the form of a volatile lead halide. The motor fuel composition may also be fortified with any of the conventional additives including anti-icing additives, corrosion-inhibitors, dyes, etc.

In accordance with practice of this invention, there may be added to a major portion of the fuel, a minor corrosion-inhibiting amount of as a corrosion-inhibiting agent a dialkoxylated alkyl polyoxyalkyl primary amine

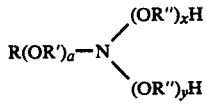

wherein R is an alkyl group, R′ and R″ are divalent alkylene groups, x+y is 2–20 and a is 1–20.

In the above formula R may be an alkyl group typified by methyl, ethyl, propyl, isopropyl, n-butyl, isobutyl, amyls, hexyls, octyls, etc. R may contain 1–20 carbon atoms preferably 10–15, most preferably 10–12 carbon atoms.

R′ and R″ may be divalent alkylene groups containing 1–8 carbon atoms, typically 1–4, say 2–3 carbon atoms. Preferably R′ is $—C_3H_4$ and R″ is

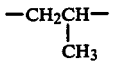

a may be 1–20, preferably 1–5, say 1–2. x may be 2–20, say 15.

Illustrative amines may be the following, the first being preferred:

TABLE

A.

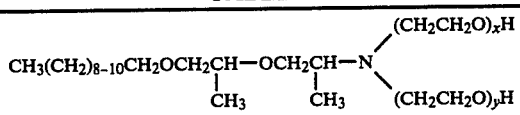

x + y = 20

B.

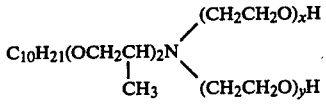

x + y = 15

C.

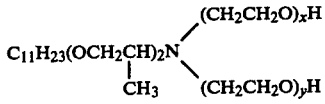

x + y = 15

D.

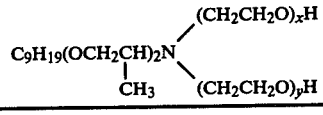

Commercially available compositions may be available under the trademark Jeffamine M-305, Jeffamine M-315, Jeffamine M-320, etc. One preferred commercially available produce may be the Jeffamine M-320 brand of

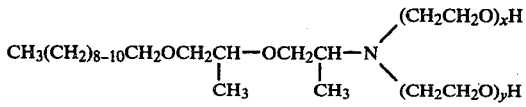

wherein x+y=20.

These materials may be commercially available or they may be prepared as by diethoxylating the Jeffamine M-300 brand of amine

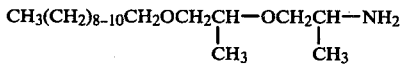

This may be done by the following well-known series of reactions illustrating a typical synthesis:

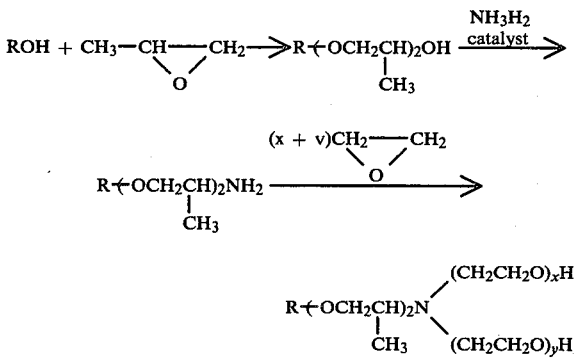

In general, the additive of the invention is added to the base fuel in a minor corrosion-inhibiting amount, i.e. an amount effective to provide corrosion-inhibition to the fuel composition. The additive is highly effective in an amount ranging from about 0.0002 to 0.2 weight percent based on the total fuel composition. The concentration ranging from about 0.0008 to 0.01 weight percent is preferred with the most preferred concentration ranging from about 0.002 to 0.008 weight percent. Typically a concentration of 0.005 may be used.

It is a feature of this invention that the fuel composition so prepared is characterized by increased resistance to corrosion and rust i.e. by decreased ability to corrode or to form rust on iron-containing surfaces during operation of internal combustion engines.

The corrosive nature of the formulations may be tested by the Nace Rusting Test of the National Association of Corrosion Engineers. In this test, a mixture of 300 ml of test fuel and 30 ml distilled water is stirred at 100° F. (37.8° C.) with a steel specimen completely immersed therein for a test period of four hours. The percentage of the specimen that has rusted is noted.

When subjected to the NACE test, the motor fuel compositions of this invention generally show a rating of trace-to 1% rust.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

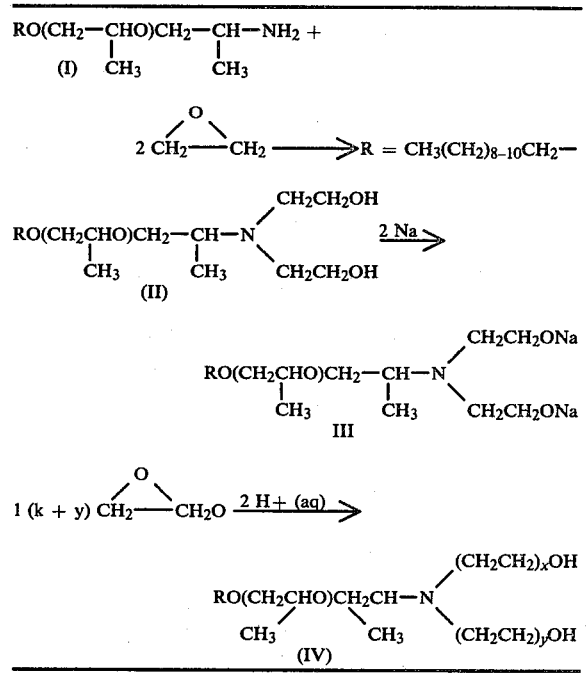

In this example which illustrates the best mode known to me of practicing the process of this invention, there is added to a reaction vessel 289.5 g (1 mole) of Jeffamine M-300 brand of (I)

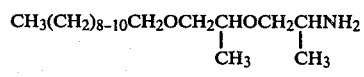

together with 200 g of diethylene glycol monomethyl ether solvent. The vessel is evacuated and flushed with nitrogen. Ethylene oxide (660 g; 15 moles) is passed in at 150° C./20 psig over 2 hours. The reaction mixture is diluted with an excess of water. Hydrochloric acid (aqueous) is added to lower the pH to about 11.

Product is II.

Water is removed by vacuum distillation followed by stripping at 165° C. under vacuum.

There is then added to the cooled reaction mixture 46 grams (2 moles) of sodium metal. After the sodium has completely reached to form III, as evidenced by stoppage of hydrogen generation, 220 g (5 moles) of ethylene oxide is passed into the reaction vessel at 50° C. for 2 hours. At the end of this time, the product is hydrolyzed by addition of 250 ml of aqueous hydrochloric acid.

The product is IV.

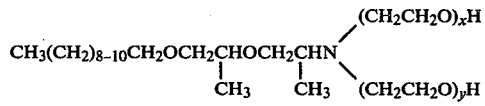

x + y = 15

Water and solvent are removed by vacuum distillation followed by stripping at 165° C. under vacuum. The product is a liquid having a molecular weight of 949.5.

5 parts per thousand barrels (corresponding to 0.0019 w %) of this composition is added to a standard gasoline.

EXAMPLE II*

In this control example, the material tested is the standard gasoline with no additive.

The control and experimental gasolines are tested in the NACE test. Results are set forth in the Table which follows the Examples.

| NACE TEST RESULTS | | |
|---|---|---|
| Example | PTB | % Rust |
| I | 5 | trace-1 |
| II* Control | 0 | 50-100 |

From this pair of comparative examples, it is apparent that the novel systems of this invention permit attainment of unexpected and superior results.

EXAMPLES I-IV

In these examples, the procedure of Example I was followed except that the charge amine was as follows:

TABLE

| EXAMPLE | AMINE |
|---|---|
| | (x + y = 15) |
| III | $C_{10}H_{21}\text{-}(OCH_2CH(CH_3))_2N\langle^{(CH_2CH_2)_xH}_{(CH_2CH_2O)_2H}$ |
| IV | $C_{11}H_{23}\text{-}(OCH_2CH(CH_3))_2N\langle^{(CH_2CH_2O)_xH}_{(CH_2CH_2O)_yH}$ |
| V | $C_9H_{19}(OCH_2CH(CH_3))_2N\langle^{(CH_2CH_2O)_xH}_{(CH_2CH_2O)_yH}$ |

EXAMPLES V-VI

In these Examples the procedure of Example I was followed except that the amount of ethylene oxide was changed and the value of x+y was therefore different.

TABLE

| EXAMPLE | Ethylene Oxide moles | x + y |
|---|---|---|
| VI | 2 | 2 |
| VII | 5 | 5 |
| VIII | 10 | 10 |

Although this invention has been illustrated by reference to specific embodiments, it will be apparent to those skilled in the art that various changes and modifications may be made which clearly fall within the scope of this invention.

We claim:

1. A fuel composition for use in internal combustion engines comprising
   (a) a major portion of a fuel containing a hydrocarbon boiling in the gasoline boiling range; and
   (b) a minor corrosion-inhibiting amount of, as a corrosion inhibiting agent, a dialkoxylated alkyl polyalkoxy primary amine.

2. A fuel composition as claimed in claim 1 wherein said fuel consists essentially of a gasoline.

3. A fuel composition as claimed in claim 1 wherein said fuel additionally contains at least one alcohol selected from the group consisting of ethanol and methanol.

4. A fuel composition as claimed in claim 1 wherein said fuel is a gasohol containing gasoline and additionally ethanol.

5. A fuel composition as claimed in claim 1 wherein said minor corrosion inhibiting amount is 0.0001-0.2 weight percent.

6. A fuel composition as claimed in claim 1 wherein said amine has the formula $$R(OR')_a\text{—}N\langle^{(OR'')_xH}_{(OR'')_yH}$$

wherein R is an alkyl hydrocarbon group, R' and R'' are divalent alkylene hydrocarbon group, x+y is 2-20, and a is 1-20.

7. A fuel composition as claimed in claim 6 wherein R is a straight chain alkyl group.

8. A fuel composition as claimed in claim 6 wherein R contains 1-20 carbon atoms.

9. A fuel composition as claimed in claim 6 wherein R contains 10-15 carbon atoms.

10. A fuel composition as claimed in claim 6 wherein R contains 10-12 carbon atoms.

11. A fuel composition as claimed in claim 6 wherein R' contains 1-8 carbon atoms.

12. A fuel composition as claimed in claim 6 wherein R' contains 2-3 carbon atoms.

13. A fuel composition as claimed in claim 6 wherein R' is $—C_2H_4—$.

14. A fuel composition as claimed in claim 6 wherein R'' contains 1-8 carbon atoms.

15. A fuel composition as claimed in claim 6 wherein R'' contains 2-3 carbon atoms.

16. A fuel composition as claimed in claim 6 wherein R'' is $$—CH_2CH(CH_3)—.$$

17. A fuel composition as claimed in claim 6 wherein a is 1-5.

18. A fuel composition as claimed in claim 6 wherein a is 1-2.

19. A fuel composition as claimed in claim 6 wherein x is 15.

20. A fuel composition for use in internal combustion engines comprising
   (a) a major portion of a fuel containing a hydrocarbon boiling in the gasoline boiling range; and
   (b) a minor corrosion-inhibiting amount, 0.002 w %-0.2 w % of as a corrosion inhibiting agent $$CH_3(CH_2)_{8-10}CH_2OCH_2CHOCH_2CHN\langle^{(CH_2CH_2O)_xH}_{(CH_2CH_2O)_yH}$$

wherein x+y is about 20.

* * * * *